United States Patent [19]

Gibbs

[11] 4,033,785

[45] July 5, 1977

[54] AIR WIPE

[76] Inventor: Charles D. Gibbs, 1406 Greenville Highway, Hendersonville, N.C. 28739

[22] Filed: Mar. 4, 1976

[21] Appl. No.: 663,657

[52] U.S. Cl. ..... 134/15; 134/32; 134/37; 134/64 R; 134/122 R

[51] Int. Cl.[2] ..... B08B 1/02

[58] Field of Search ..... 134/64 R, 122 R, 15, 134/32, 37

[56] References Cited

UNITED STATES PATENTS

| | | | |
|---|---|---|---|
| 3,044,098 | 7/1962 | Stalson | 134/64 R |
| 3,736,618 | 6/1973 | Ramsey | 134/64 R |

*Primary Examiner*—Arthur D. Kellogg
*Attorney, Agent, or Firm*—James J. Cannon, Jr.; James J. Cannon

[57] ABSTRACT

An air wipe device to direct linearly displaced opposing jet streams of compressed air or pressurized solvent, to incrementally remove adhering particulate matter from a linearly drawn article of indefinite length passing through a central channel. The air wipe is characterized by a plurality of transverse extrusion channels defined by oblique swept baffles, each extrusion channel having mediately positioned opposing jet stream orifices and each channel further communicating and merging with longitudinal exhaust channels coaxial with the central article channel, the exhaust channels terminating in exhaust ports adjacent to, but displaced from, a central wire entrance orifice. Jet stream orifices are designed to impinge high velocity air or solvent upon the passing article at an acute angle to the line of article travel, the swept baffles thereafter causing the particulate laden dispersed jet streams to be diverted from the passing article, directed and exhausted via the transverse extrusion channels and exhaust channels in a direction opposing the direction of article travel.

14 Claims, 6 Drawing Figures

AIR WIPE

FIELD OF THE INVENTION

The present invention relates to air wipe devices by which a linearly drawn article of indefinite length, usually a wire, may have adhering particulate matter upon its surface removed by a plurality of impinging high velocity jet streams of air or solvent. The invention further relates to diversion of particulate matter away from the article for most efficient cleaning action.

DESCRIPTION OF THE PRIOR ART

Air wipes are commonly used to remove excess undesired particulate matter of various sorts from article surfaces, primarily the surfaces of linearly drawn wire of indefinite length. Particularly, as is accomplished by the present invention, water, oil or other fluids and loose metallic dust or scale particles may be removed from the surface of bare or insulated wire or cable, metallic rods and other similar articles. Such devices, as air wipes, facilitate improved performance and accuracy of in-process electric diameter and concentricity gauges for wire, for example. Spark testers yield improved performance due to air wipe removal of water droplets or films which can cause false fault counts and can create shock hazards to operating personnel. Furthermore, many products need to be free of paticulate matter before proceeding to further steps during the process of manufacture.

Common air wipes have a single orifice or several orifices arranged in a ring directing pressurized air jet streams at an acute angle upon a passing wire. The wire usually passes through a chamber in a plane at an acute angle to the plane of the jet stream orifices which, to increase efficiency of the cleaning and/or the speed of the passing wire, have been placed in an annular or circular formation which encompasses the wire. The jet stream orifices are usually positioned near the wire entrance to the chamber, in effect cleaning the wire as it simultaneously enters the chamber. The forward portion of the chamber has been commonly designed with a venturi portion to aid in the dissemination of jet stream discarded particulate matter away from the entering wire. Thus, in effect, air wipe jet streams contact the wire surface only once. To increase the efficiency of air wipes having a plurality of jet stream orifices, it is thereby necessary to create higher velocity jet streams which, as a consequence adds a great deal of noise to an already noisy process and adds a consequent increase in cost due to the greater consumption of compressed air.

The present invention, in contrast to the prior art, has a multiple number of jet stream orifices in tandem sets aligned linearly in a rectangular housing, having upper and lower symmetric halves; that is, each half has a linear disposition of jet stream orifices opposing those of the other half which direct high velocity jet streams upon a passing wire. The housing is longitudinally symmetrical also. A transverse V-shaped extrusion channel corresponds to each set of orifices, the channels being defined by directory baffles which are an integral part of the housing. The jet stream orifices are positioned in the extrusion channel adjacent to their corresponding baffle portion.

The extrusion channels merge at their ends into longitudinally running exhaust channels through which the particulate laden air may exit adjacent to the wire entrance orifice. The action of individual combinations of jet streams impinging upon the passing wire acts to incrementally clean the wire and completely divert particulate matter from the wire, which has been a problem of the prior art.

The most relevent patent as compared to the present invention is U.S. Pat. No. 2,967,119 Gutterman which employs baffles and directed warm, pressurized air to remove a solvent from photographic film. The baffels serve a protective function in that they prevent premature contact of the air stream with and resultant premature evaporation of solvent from the film, prior to direct contact with the air. The baffles, aligned to divert the air away from the film, also act to assist the direction of the resultant solvent spray to the exhaust ports. It should be noted that this device is classified as a drier designed primarily to evaporate low vicosity solvents rather than remove particulate matter as in an air wipe. Whereas the baffles of the Gutterman device act primarily to divert the jet stream and disseminate the same, the baffles of the present invention act to concentrate the pressure from the jet stream striking the passing wire and divert the same.

In contrast to prior art air wipes, the present invention obtains maximum efficiency for a plurality of jet streams by effectively acting upon the passing wire in each channel thereby removing matter incrementally. It is an object of the present invention to effectively clean or treat the passing article at high speeds with modest compressed air consumption and low noise levels. Thus, the process of incremental removal of particulate matter by the present invention allows a substantial increase in the speed of the passing article traveling through the air wipe and also effects a more efficient removal of matter than prior art devices. The invention is very effective in removing scale or other matter which may stubbornly cling to the surface of the wire to be cleaned which, in effect, greatly slows down prior art air wipe processes if they are to remove effectively such matter.

Finally, since the removed particulate matter is diverted to the outer exhaust channels through the transverse extrusion channels, being aligned perpendicular to the jet stream flow, the exit of all matter may be easily directed away without interfering with the entering article and with minimal noise.

SUMMARY OF THE INVENTION

The air wipe of the present invention is divided by a horizontal plane into two distinct mating housing halves, each characterized by a plurality of linearly disposed, tandem opposing jet stream orifices, served by a manifold, which direct pressurized air, other gases, or even fluids to impinge upon a passing wire or other similar extruded articles to clean adhering particulate matter from the surface of the passing wire. The resultant removed particulate matter is diverted away from the passing wire through transverse V-shaped extrusion channels, each channel corresponding to a pair of jet stream orifices. The extrusion channels are defined by similar obliquely shaped mating baffles to which the jet stream orifices are placed adjacent thereto.

The mating baffles are machined to the desired size, having a central annular groove, for passage of the wire therethrough, thus also creating a longitudinal central channel within the housing. A vertical plane extending along the center of this longitudinal central channel will also divide the apparatus symmetrically. The baffles are pointed in the direction of the passage of the article thereby allowing the extrusion channels to create a flow of particulate laden pressurized air away from the passing article to longitudinal exhaust channels which are coaxial with the central channel. The particulate matter is thereby exhausted adjacent to, on either side of, the entrance orifice of the central channel in a direction opposite to that of the passing wire.

The jet stream orifices may be positioned at the apex of the extrusion channels and, as previously mentioned, adjacent to the corresponding channel baffle. It is preferably desired that the jet stream be directed to impinge upon the passing article at an angle of 75°, the object being to prevent vortex formation and maintain an equal outward pressure flow throughout the extrusion channels. Various other acute impinging jet stream angles may be used, however, which could further facilitate the removal of adhering particles, the angles being dependent upon the type of adhering matter and desired wire speed.

It is therefore an object of the present invention to wipe incrementally a passing article in a plurality of distinct apparatus sections to achieve greater efficiency and wiping effectiveness of the air wipe process. As a result of the design it is possible to increase the speed of a passing article to achieve greater productivity as compared to the prior art. The present invention diverts particulate matter away from the passing article immediately thereby preventing any redeposition of any removed matter which is possible in prior art air wipes, due to ineffective diversion. Also, for example, a portion of high viscosity fluids such as oil, which would cling to and be pushed along the surface rather than be removed, would necessitate a slower wire speed or a higher jet stream pressure to be effectively cleaned. In contrast, the present invention, through its incremental cleaning action, effectively cleans such deposited surfaces while maintaining maximum wire speed.

It is therefore an object to keep the usage of compressed air to a minimum which also is allowed by the incremental cleaning action. Finally, due to the fact that the jet stream orifices are located within the interior of the apparatus and that the exit portion of the exhaust chamber may have a venturi opening or other opening, as desired, the resultant noise of the process is reduced substantially.

Further features and advantages will become apparent from the following drawings and descriptions thereof.

DESCRIPTIONS OF THE DRAWINGS

Figure 1:
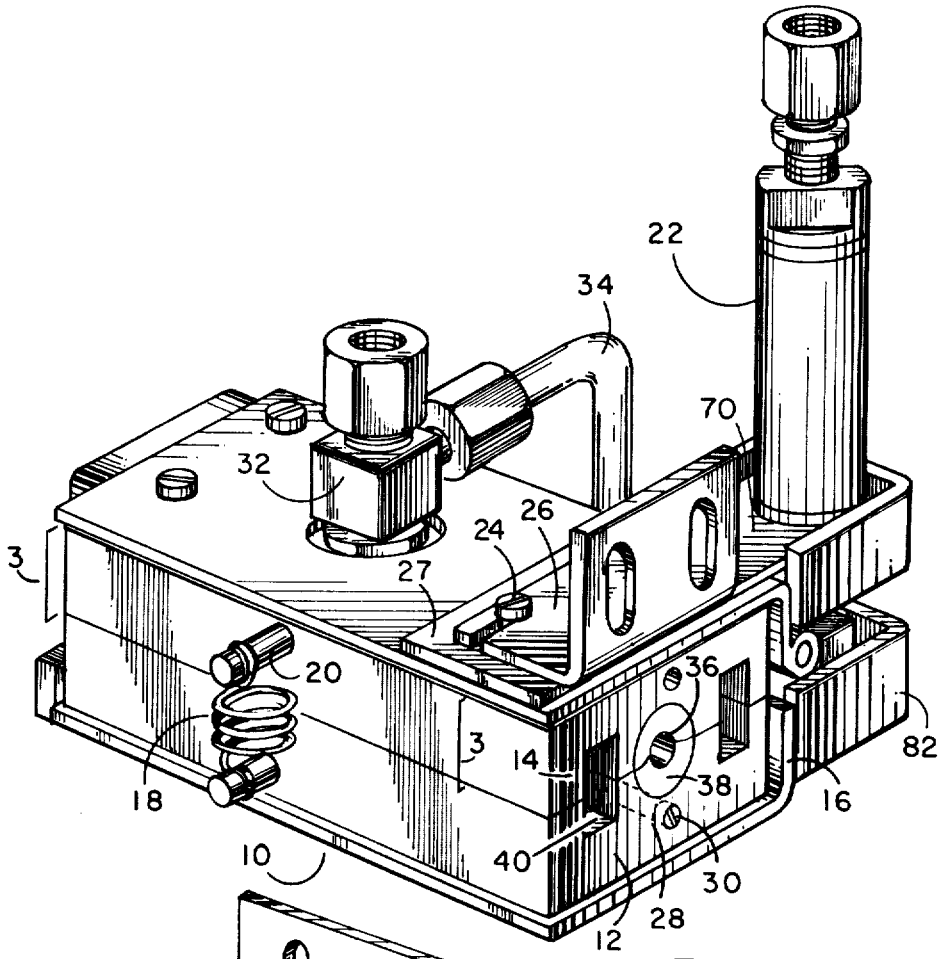
FIG. 1 is a front perspective view of the body of the air wipe apparatus of the present invention including mounting means and a mounted pneumatic cylinder device for remote opening and closing of the air wipe device.
Figure 2:
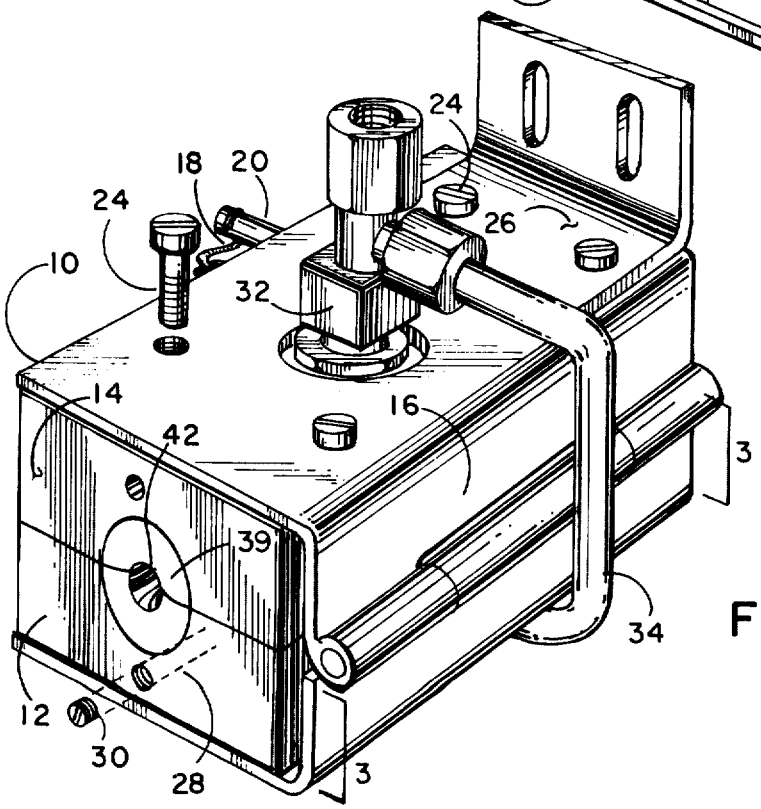
FIG. 2 is a rear perspective view of the body of the air wipe of the present invention.

Referring now to FIGS. 1 and 2, the rectangular air wipe apparatus of the present invention is generally designated by reference numeral 10. Air wipe 10 consists of two symmetrical mating machined halves 12, 14 as defined by line 1—3, which together encompass a passing wire or other similar linear article to be cleaned. Housing body halves 12, 14 are operatively connected by heavy hinge 16. When in operation, halves 12, 14 may be secured together by spring 18, the ends of which may be secured around arms 20 which are screwably secured in machined bores on the sides of body halves 12, 14. Use of cylinder 22 of FIG. 1 for remote opening and closing of mating halves 12, 14 may eliminate the need for securing spring 18. Thus, due to hinge 16, air wipe 10 may be easily opened to string up the wire line, to permit automatic or manually directed passage of knots or lumps upon the wire line, and to facilitate maintenance and cleaning of air wipe 10.

Heavy hinge 16 is secured to each operative air wipe half 12, 14 by four screws collectively numbered 24, which are secured in mating female machined bores in each half. Air wipe 10 is designed to be mounted upon a surface perpendicular to the line of wire travel such as to the inside or outside of a capstan housing or the end of a water trough by means of a mounting bracket 26 secured by a pair of screws 24, preferably those upon the forward portion of upper half 14, as illustrated; however, mounting bracket 26 may be mounted on any of the four areas of the body of air wipe 10 by a pair of screws 24, as may be required by a particular application, thus providing flexibility of attachment and usage. As illustrated by FIG. 1 cylinder 22 may also be secured by screws 24 to mounting bracket 26 if desired.

Each machined half 12, 14 contains a manifold 28 which delivers pressurized air or solvent, as the application may require, to paired jet stream orifices to provide the desired cleaning action. Manifold 28 is simply a machined annular bore, extending longitudinally within the body of each half, blocked at its ends by appropriate plug means 30. Annular manifold 28 communicates with a centrally located machined female bore which is fixably connected to male fitting 32, positioned in a circular cut-out aperture of hinge 16. Fitting 32 communicates with appropriate tubing 34 which delivers a supply of high velocity compressed air or pressurized solvent to each housing half.

Centrally located article entrance orifice 36 (FIG. 1) is circumscribed and defined by split bushings 38, comprised of sintered alundum or other appropriate material, to protect air wipe 10 from wear due to poorly centered or vibrating wire. Central orifice 36, formed by split bushing 38, may have a venturi opening to facilitate this objective. Exhaust ports 40 are located on both sides of central wire entrance orifice 36 and direct removed particulate laden air out of air wipe 10 and away from the entering wire. Wire exit central orifice 42 (FIG. 2) is constructed as is orifice 36 by using identical split bushings 39. Entrance and exit orifices 36, 42 may have various diameters, the diameter being approximately twice the diameter of maximum wire size for optimum efficiency.

Figure 3:
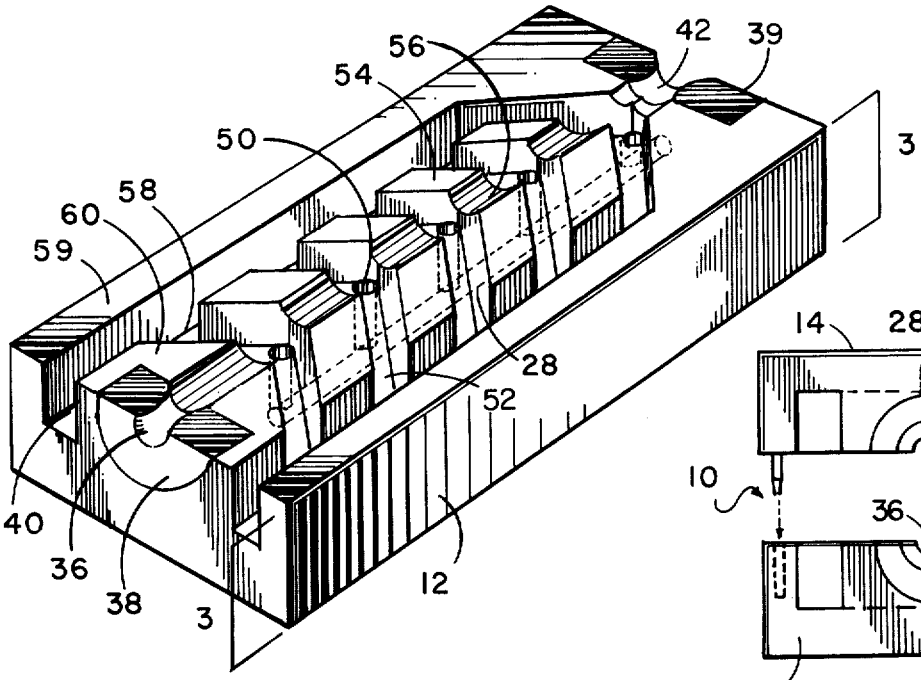
FIG. 3 is a perspective view along line 3—3 of FIGS. 1 and 2, of the operative interior of one of the symmetrical machined mating halves of the air wipe of the present invention.

Referring now to FIG. 3 which illustrates a perspective view of mating body half 12 along lines 3—3 of FIGS. 1 and 2, it should be noted that body half 14 is identical to body half 12. Air wipe 10, is designed for the in-process removal of cooling water, lubricants and foreign particulate matter from bare and coated wires and similar linearly drawn articles of indefinite length at line speeds of 1000 feet per minute and above due to the unique embodiment of air wipe 10.

Air wipe 10 uses five linearly aligned pairs of jet stream orifices 50 in tandem to direct high pressure air or solvent from manifold 28 at an angle to the line of wire travel to strip undesired adherent material from the passing wire. Body halves 12, 14 are machined for passage of the wire to be cleaned, for the passage of air through manifold 28 to orifices 50, and for the extrusion of removed particulate matter through exhaust ports 40.

Body halves 12, 14 are characterized by transverse extrusion channels 52, each channel 52 corresponding to a pair of jet stream orifices 50 and defined by V-shaped or obliquely swept mating baffles 54. Baffles 54 are swept at an obtuse angle with respect to their arms, each arm being at an acute angle with respect to the passing article. As illustrated the angle is approximately 60°. Baffles 54 are machined at the convergence of their arms, being the apex, to form a longitudinal annular central passage 56 for the wire to pass therethrough, the diameter of passage 56 depending upon wire diameter and depending upon the same parameters as the diameter of central orifices 36, 42. A vertical plane through longitudinal central passage 56 will further divide body halves 12, 14 symmetrically.

The passing article enters central passage 56 through orifice 36 and exits through orifice 42; thus baffles 54 and corresponding extrusion channels 52 are swept obliquely opposing the direction of the passing article. Extrusion channels 52 communicate with and merge into longitudinal exhaust channels 58, coaxial with central passage 56, which are defined by side wall 59 and the outer machined edges of swept baffles 54. Exhaust channels 58 thereby merge with rearmost extrusion channel 52 and terminate at exhaust ports 40. It should be noted that the foremost V-shaped baffle portion 60 is integrally formed with the end of the body and provides a wall against which split bushing 38 is placed. Body halves 12, 14 are machined at the rear to also provide a wall against which rear exit bushing 39 may be placed.

Jet stream orifices 50 are simply annular bores in channels 52 of body halves 12, 14 which communicate with manifold annular bore 28. Orifices 50 are positioned at the rearmost portion of each extrusion channel 52. Preferably in air wipe 10, orifices 50 are designed to direct impinging air at an acute angle of 75° to the direction of the passing wire. Extrusion channel 52, in combination with baffles 54, thereby divert and direct particulate laden air or solvent to exhaust ports 40 via exhaust channels 58. Although jet stream orifices could be placed near the front of the extrusion channels 52 or be placed to impinge upon the article at various angles, air wipe 10 is most efficient as above described and embodied for most applications.

Air wipe 10, therefore, when halves 12, 14 are placed together for operation, will force particulate laden air or solvent out exhaust ports 40 in a direction opposite that of the passing wire. Mating baffles 54 of each half will be in communication, to distinctly define transverse extrusion channels 52, except for annular article passage 56. Each half has one jet stream orifice per extrusion channel and, when mated, form a pair of orifices, each orifice being 180° from the other, the pairs being displaced longitudinally along the central passage. Due to the placement of orifices 50 at the rear of extrusion channels 52, no removed particulate matter will pass through central passage 36, but will be diverted to exhaust channels 58.

Figure 5:
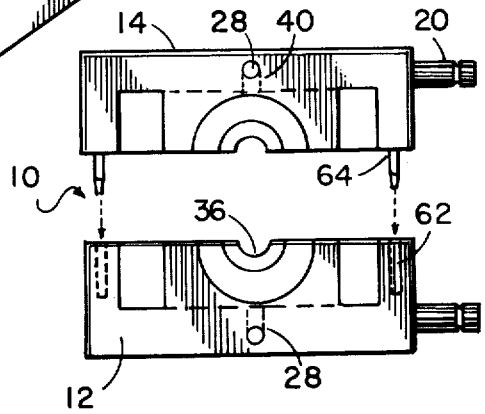
FIG. 5 illustrates an end view of the air wipe of FIG. 1.
Figure 4:
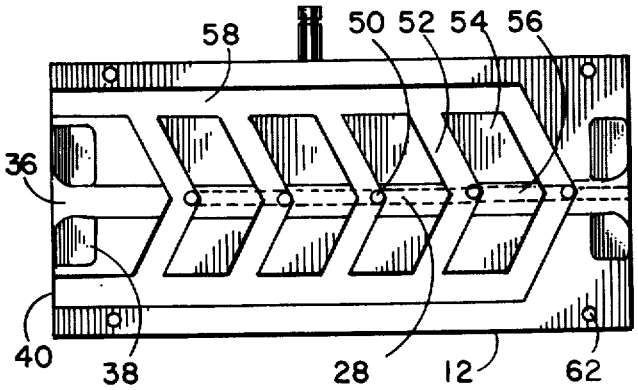
FIG. 4 illustrates a top view of the machined symmetrical mating half of FIG. 3.

FIGS. 4 and 5 simply illustrate a top and end view respectively of the operative interior of air wipe 10 of FIG. 3. Manifold 28 is illustrated in dotted outline to show its relation with jet stream orifices 50. Bores 62, positioned at each of the corners of body half 12, each receives a complimentary mating male arm 64 (FIG. 5) to align body halves 12 and 14 and prevent independent movement of the housing halves 12, 14 during operation.

Figure 6:
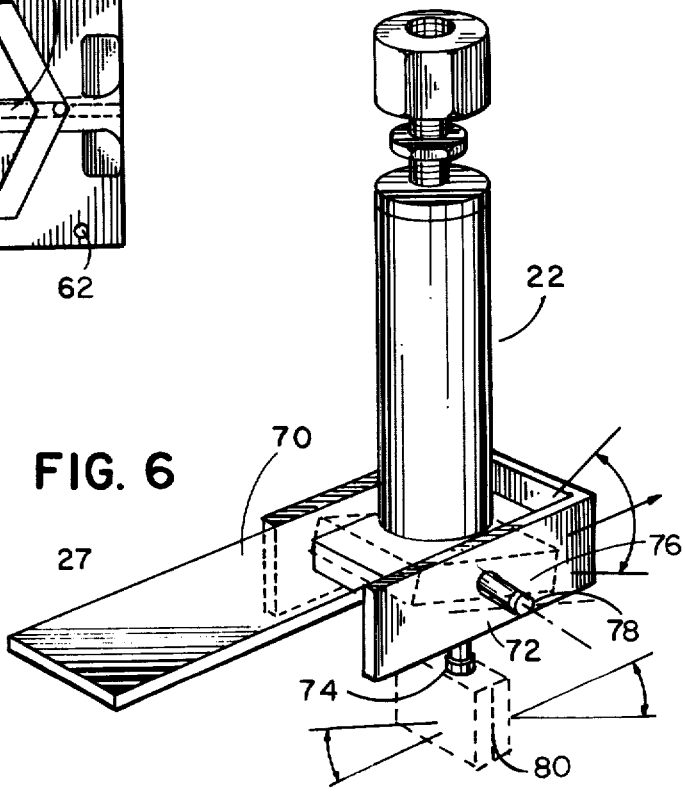
FIG. 6 illustrates the pneumatic cylinder of FIG. 1 and the relative movement of the same.

FIG. 6 illustrates pneumatic cylinder 22 which may be remotely controlled to open and close air wipe halves 12, 14. The cylinder base rests upon rectangular plate 70 suitably attached to a supporting U-shaped bar 72 around the end. Cylinder rod 74 passes through an aperture of plate 70. Plate 70 is secured to hinge 16 of air wipe 10 (FIG. 1) by a pair of screws 24, preferably attached with mounting bracket 26. Cylinder rod 74 further passes through upper base plate 76. Base plate 76 is movably secured within U-bar 72 by pins 78 (opposing side not shown) and is vertically movable upon the axis formed by pins 78. Upper base plate 76, thus by contacting plate 70, directs the movement of hinge 16 and upper housing half 14. Cylinder rod 74 at its lower extent rests upon lower base plate 80. Base plate 80 is secured to U-bar 82 (FIG. 1) which abuts hinge 16 and lower housing half 12 to cause the relative movement of housing half 12.

Principal components of air wipe 10 are of stainless steel and anodized aluminum. Provisions are generally made for varying air pressure to permit adjusting air or other jet stream component to the lowest pressure consistent with adequate wiping action. Air wipe 10, for most applications, will use air at the rate of approximately 10 cfm at 80 psi to achieve the desired wiping speed of 1000 fpm of wire travel. Due to plug means 30, manifold 28 may be cleaned by removing said plugs and blowing out debris under pressure. Jet stream orifices 50 may be cleaned with appropriate small drill bit.

The inventor believes the air wipe of the present invention to be a substantial improvement over prior art devices due to the diversion of particulate laden dispersed jet streams (air or solvent) away from the cleaned wire and due to the incremental cleansing action which will successively strip off adhering material. Also as previously stated, since the cleansing action occurs within the housing, the noise attendant with the process is greatly reduced.

Depending on the specialized application for which air wipe 10 is used, many of the design parameters illustrated in the preferred embodiment may be altered, without affecting the novelty or effectiveness of the preferred embodiment. The variable factors relevant to optimum design are the article to be wiped, the speed of the article passing through the air wipe, the material to be wiped off the article and cleaning medium utilized. For example, jet stream orifices need not be the same size, that is, they may vary in diameter; jet stream orifices may be staggered in each machined half 12, 14 of air wipe 10. Additionally, jet stream orifices may be positioned to have the cleaning medium strike the passing article tangentially, thus creating a spinning effect. Likewise, only one-half 12 of air wipe 10 need have channels 52 and baffles 54. There may be a multiplicity of channels 52. Baffles 54 may be at any angle up to 90°, depending on the variable factors. Some applications may be improved by four tandem rows of jet orifices 50, rather than two as shown.

Thus the inventor does not wish to be specifically limited to the preceeding description as various modifications may be made without departing from the spirit and principles of the disclosure; accordingly, the invention should be limited only by the spirit and scope of the following claims.

I claim:

1. An air wipe to remove adhering particulate matter from a linearly drawn passing article of indefinite length having article entrance and exit orifices and opposing tandem jet stream orifices, within mating housing halves, directing impinging pressurized jet streams upon said article passing through an annular central housing passage comprising:

a plurality of transverse extrusion channels defined by corresponding V-shaped swept baffle means, swept obliquely with respect to the direction of article travel, each extrusion channel having opposing tandem jet stream orifices, to divert particulate laden dispersed jet streams at a lateral acute angle, with respect to said passing article, in a direction opposing the direction of movement of said article;

longitudinal exhaust channels coaxial with said central article passage communicating and merging with said extrusion channels and terminating in exhaust ports adjacent to, but displaced from, said article entrance orifice to divert said particulate laden dispersed jet streams away from said entering linearly drawn article;

said jet streams impinging upon said article at an angle less than 90° and said opposing tandem jet stream orifices placed 180° apart;

said swept baffle means having a machined annular groove, for passage of said wire, at the apex of said baffle means, the convergence of the arms of said baffle means being said apex, with said linear article forming an acute angle with respect to said baffle means swept arms.

2. An air wipe for the removal of adhering particulate matter from a passing linearly drawn article having symmetrical mating housing halves each half being longitudinally symmetrical, having venturi article entrance and exit orifices and an annular central passage communicating therewith comprising:

a plurality of transverse extrusion channels;

V-shaped swept baffle means defining said extrusion channels;

said swept baffle means forming an acute angle in relation to said linearly drawn article;

said sweep being in a lateral direction opposing the directional movement of said passing article;

longitudinally disposed opposing jet stream orifices arranged in tandem paired sets, said orifices being positioned coincident with each of said extrusion channels and further coincident with said annular central article passage, thereby directing high velocity jet streams upon said article passing through said extrusion channel;

longitudinal exhaust channels, coaxial with said central annular passage, defined by the outer extent of said baffle means and the outer housing wall, said transverse extrusion channels merging and communicating therewith;

said exhaust channels terminating in exhaust ports, preferably having a venturi opening, adjacent to but displaced from said central article entrance orifice, to direct particulate laden air from said entering article;

said baffles diverting particulate laden dispersed jet streams from said passing article via said extrusion channels to said exhaust ports via said exhaust channels in a direction opposing the movement of said passing article;

manifold means within each housing half, preferably being an annular bore, communicating with said jet stream orifices to supply said jet stream orifices from a pressurized source; and said central article passage being a machined annular groove through the apex of said baffles, said baffles of each mating half being in communication.

3. The air wipe of claim 2 wherein said opposing jet stream orifices tandem sets are positioned at the rearward apex of each of said extrusion channels and adjacent to said baffle means.

4. The air wipe of claim 2 wherein each of said orifices of said tandem set direct impinging jet streams at unequal acute angles upon said passing article.

5. The air wipe of claim 2 wherein said jet stream orifices have equal diameters.

6. The air wipe of claim 2 wherein said jet stream orifices have various diameters.

7. The air wipe of claim 2 wherein each of said extrusion channels has more than two opposing jet stream orifices, each opposed pair forming a tandem set, said orifices being displaced to direct impinging jet streams tangentially upon said passing article.

8. The air wipe of claim 2 wherein said sweep of said baffles ranges from a slight acute angle to 90°.

9. The air wipe of claim 2 wherein said jet streams consist of pressurized fluid solvents.

10. The air wipe of claim 2 wherein said jet streams consist of compressed air.

11. The air wipe of claim 2 wherein said housing half is fixably secured to a heavy hinge for simple opening and closing of said air wipe to be operated manually and secured manually by a spring attached to arms extending from each of said mating halves.

12. The air wipe of claim 2 wherein each housing half is fixably secured to a heavy hinge and further secured to a pneumatic cylinder for remote opening and closing of said air wipe mating halves.

13. An air wipe, for incremental removal of adhering particulate matter from a passing linearly drawn wire, having symmetrical mating halves, each half being longitudinally symmetrical, and having entrance and exit orifices and a central passage communicating therewith comprising:

a plurality of transverse extrusion channels;

V-shaped swept baffles defining said extrusion channels, said baffles being swept obliquely at an angle opposing the direction of movement of said passing wire;

a plurality of pairs of opposing jet stream orifices, each pair corresponding to one of said extrusion channels and coincident with said central passage at the rearward apex of said extrusion channels;

said baffles diverting particulate laden dispersed jet streams from the line of travel of said passing wire at a lateral acute angle via said extrusion channels;

longitudinal exhaust channels coaxial with said central passage communicating and merging with said extrusion channels, said exhaust channels terminating in exhaust ports, adjacent to but displaced from said central wire entrance orifice to direct particulate laden air from said extrusion channels via said exhaust channels away from said entering wire; and manifold means, within each housing half connected to a pressurized jet stream supply means, communicating with and directing jet stream supply to said jet stream orifices, said manifold means being longitudinally coaxial with said central passage.

14. A method for the incremental removal and diversion of adhering particulate matter from a continuously running linearly drawn wire whereby high velocity jet streams impinge upon said passing wire, the method comprising:

impinging said passing wire with a plurality of high velocity paired opposing concentrated jet streams, said pairs being linearly displaced along the line of wire travel and impinging upon said wire at an acute angle, to the line of wire travel;

diverting particulate laden dispersed jet streams laterally through angular transverse extrusion channels, said channels being symmetrical on either side of the line of said passing wire; and exhausting said particulate laden dispersed jet stream away from said wire through longitudinal exhaust channels coaxial with the line of wire travel in a direction opposing the line of wire travel.

* * * * *